United States Patent [19]

Loewenthal

[11] 4,253,293

[45] Mar. 3, 1981

[54] APPARATUS FOR INSERTING FINNED PACKAGES INTO CONTAINERS

[75] Inventor: Horst Loewenthal, Tiengen, Fed. Rep. of Germany

[73] Assignee: SIG Schweizerische Industrie-Gesellschaft, Neuhausen am Rheinfall, Switzerland

[21] Appl. No.: 19,606

[22] Filed: Mar. 12, 1979

[30] Foreign Application Priority Data

Mar. 15, 1978 [CH] Switzerland ..... 2832/78

[51] Int. Cl.[3] ..... B65B 35/36

[52] U.S. Cl. ..... 53/537; 53/247

[58] Field of Search ..... 53/473, 171, 244, 247, 53/248, 537, 538, 539; 294/116; 414/69

[56] References Cited

U.S. PATENT DOCUMENTS

| | | | |
|---|---|---|---|
| 2,709,029 | 5/1955 | Cox | 53/247 |
| 2,760,316 | 8/1956 | Okulitch | 53/539 X |
| 2,815,623 | 12/1957 | Holstebroe | 53/538 X |
| 3,029,100 | 4/1962 | Laine | 294/116 X |
| 3,082,584 | 3/1963 | Schmid | 53/171 X |
| 3,179,460 | 4/1965 | Gunzelmann | 294/116 |
| 3,410,046 | 11/1968 | Johnson | 53/247 X |
| 3,630,391 | 12/1971 | Wilson | 294/116 X |
| 3,631,651 | 1/1972 | Kopp | 53/247 X |
| 3,778,965 | 12/1973 | O'Lenick et al. | 53/248 |

*Primary Examiner*—John Sipos

*Attorney, Agent, or Firm*—Spencer & Kaye

[57] ABSTRACT

An apparatus for inserting finned packages into a container, in successive groups of laterally juxtaposed packages, by clamping at least one fin of each package in a group in a common clamping device composed of a movable clamping jaw and a counter jaw, introducing the clamped-in packages into a container, and releasing the clamping device to deposit the group of packages in the container.

7 Claims, 12 Drawing Figures

IV
II
4
3
5
6
7
8
9
10
11
12
15
16
18
19
20
21
22
23
24
25
26
27
29
32

APPARATUS FOR INSERTING FINNED PACKAGES INTO CONTAINERS

BACKGROUND OF THE INVENTION

The present invention relates to apparatus for inserting groups of laterally juxtaposed finned packages into containers.

A finned package is a package which contains several pieces and which is closed at its ends by welded or sealed seams which protrude in the form of fins.

Various techniques for accomplishing this have already been proposed. Thus, German Auslegeschrift [Published Patent Application] No. 2,240,541 describes a device in which individual packages are held by suction cups and placed into a box by interrupting the suction pressure of the suction cups so that the packages drop into the box. Such a device is complicated and relatively slow in operation. Moreover, the suction cups will hold the packages properly only if the latter have a smooth, planar surface. Since this condition will be met not at all or only insufficiently in many cases, apparatus of this type is subject to frequent malfunctions.

SUMMARY OF THE INVENTION

It is an object of the present invention to overcome these drawbacks.

These and other objects are achieved, according to the present invention, by inserting finned packages into a container, in successive groups of laterally juxtaposed packages, by performing the operations of clamping at least one fin of each package in a group in a common clamping device, introducing the clamped-in packages into a container, and releasing the clamping device to deposit the group of packkages in the container.

The objects according to the invention are further achieved by the provision of apparatus for inserting finned packages into a container in successive groups of laterally juxtaposed packages, which apparatus includes a common clamping device for holding one group of packkages at a time and composed of an element defining at least one counter jaw, and means defining a clamping jaw movable relative to the counter jaw for clamping all fins on one side of a group of packages introduced into the clamping device against the counter jaw.

The common clamping device can be produced relatively inexpensively and eliminates need for a vacuum pump so that it operates very reliably even at high operating speeds. Due to the fact that the packages are clamped in at their fins and not at some other point of the package it is assured that the contents of the package will be treated gently even though the package itself is clamped in tightly.

DESCRIPTION OF THE PREFERRED EMBODIMENTS

Figures 1, 3:
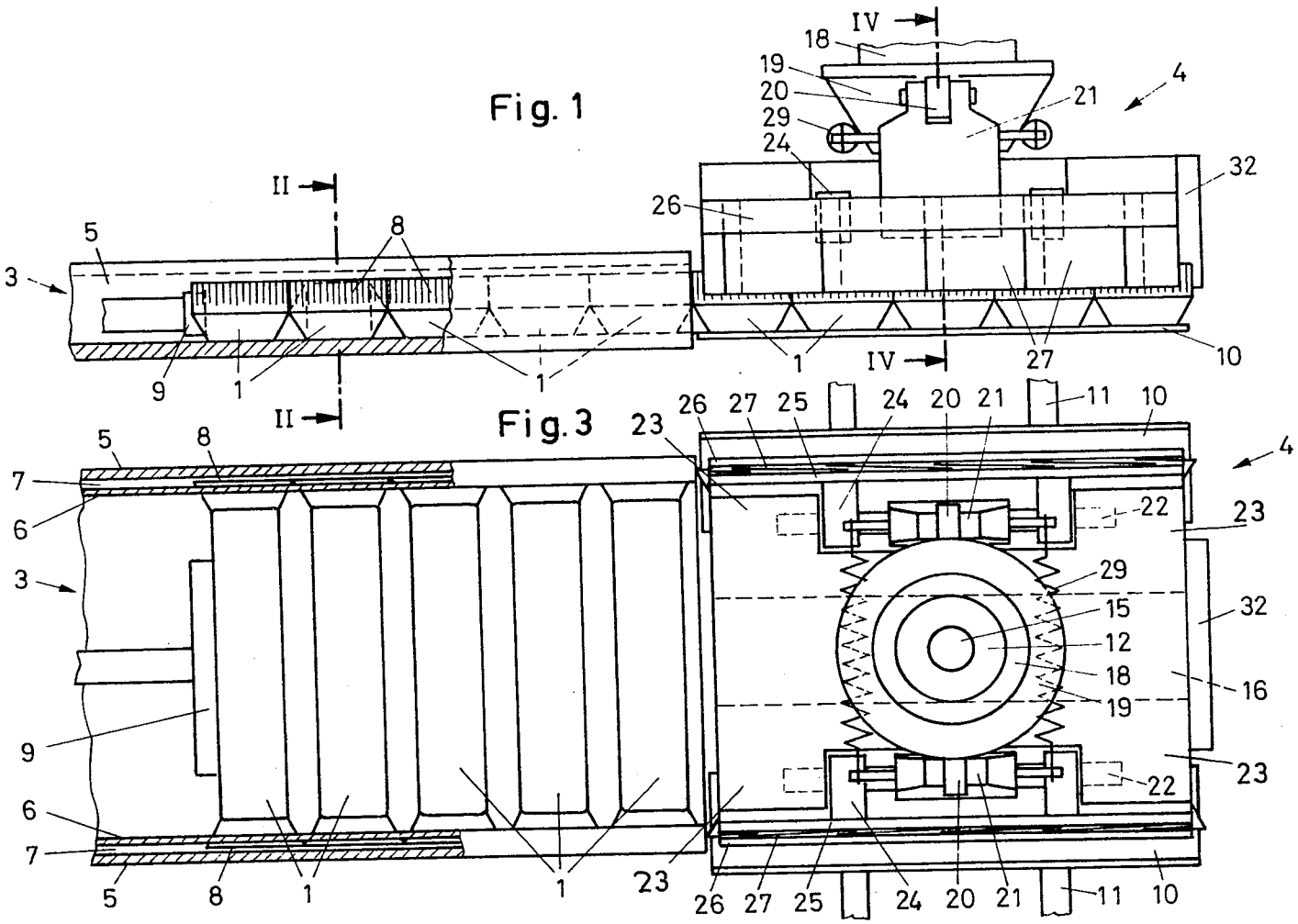
FIG. 1 is a front elevational view of a first embodiment of an inserting apparatus according to the invention.
FIG. 3 is a top plan view of the apparatus of FIG. 1.
Figure 2:
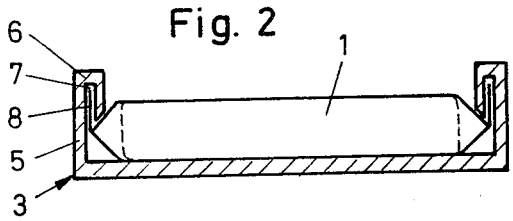
FIG. 2 is a cross-sectional view along the line II—II of FIG. 1.
Figure 4:
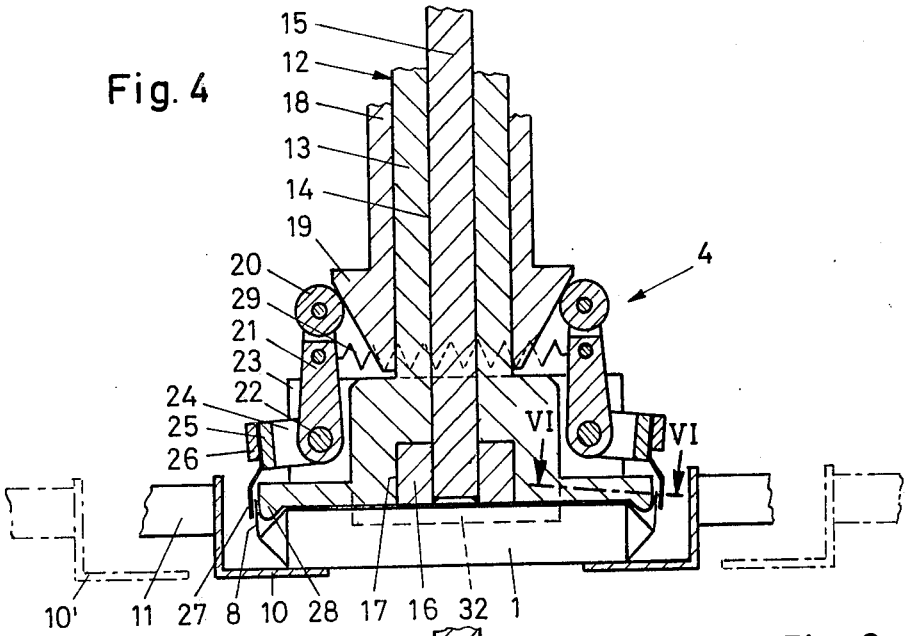
FIG. 4 is a cross-sectional view along the line IV—IV of FIG. 1.
Figure 5:
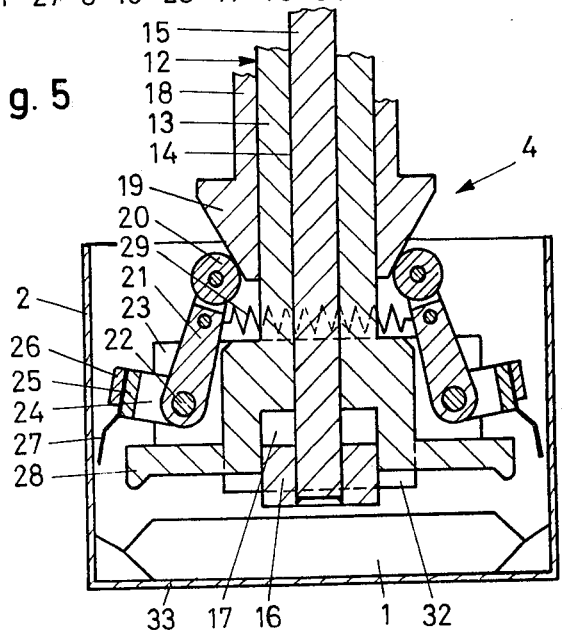
FIG. 5 is a cross-sectional view like that of FIG. 4 but with the parts in a different position.

The embodiment illustrated in FIGS. 1–6 serves to insert finned packages 1 into cardboard containers, or boxes, 2, as shown in FIG. 5. Referring particularly to FIGS. 1–3, the packages 1 are brought through a feed channel 3 to a clamping device 4. The channel 3 is fixed to the apparatus housing or frame and has a U-shaped cross section, as is particularly shown in FIG. 3, and its two side walls 5 are each provided with an inwardly protruding upper edge 6 formed to present a downwardly open groove 7. The "fins" 8 of packages 1 engage into the grooves 7 after having previously been folded upwardly in a known manner, for example by means of wedge pieces (not shown). Fins are usually understood to mean package closing seams which have been formed by sealing or welding. The seams are shown in FIG. 1 with vertical hatching which is suggestive of their actual appearance.

The packages, filled for example with wafers, pieces of chocolate or the like, are arranged in lateral juxtaposition and transverse to the longitudinal direction of channel 3, whose width corresponds to the length of a package exclusive of its fins. A pusher 9 is periodically inserted from the top into channel 3, in a manner which, because it is standard procedure in the art, will not be described in detail, to introduce the five packages 1 shown in FIGS. 1 and 2 to be at the outlet end of channel 3 into the clamping device 4 by moving those five packages rapidly ahead of the other packages in channel 3. The ends of these five packages 1 are thus moved from channel 3 onto two supports 10, shown particularly in FIG. 4, which are firmly connected with actuating members 11 to be displaceable in opposition to one another.

The clamping device 4 includes an element 12 which preferably is movable in a vertical direction with respect to the channel 3. The element 12 includes an upper, vertical, cylindrical portion 13 provided with an axial bore 14 in which a plunger 15 can be displaced. At its lower end, the plunger 15 is provided with a head 16 which extends in the form of a strip above the five packages 1 in device 4 and rests in a recess 17 of element 12 as long as the plunger 15 is not being actuated.

A sleeve 18, whose lower end is provided with a downwardly tapering conical control head 19 is vertically displaceable on the outside of the cylindrical portion 13. The conical face of head 19 serves to control the mutually oppositely directed movement of two rollers 20 which are attached to the upper ends of respective ones of two symmetrical levers 21. Near the upper end of each lever 21, there is provided a pin or rod projecting from both sides thereof. At each end of this pin or rod there is connected one end of a respective tension spring 29 whose other end is connected to the comparable pin or rod of the other lever 21.

Each lever 21 is fastened to a respective horizontal shaft 22 which is mounted in bearings 23 secuured to element 12.

Figure 6:
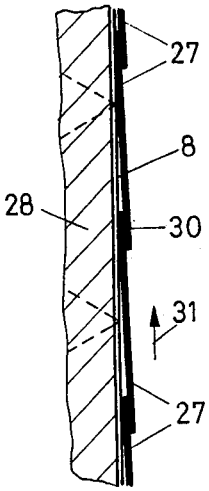
FIG. 6 is a cross-sectional plan view along the line VI—VI of FIG. 4 and to a larger scale.
Figures 7, 10:
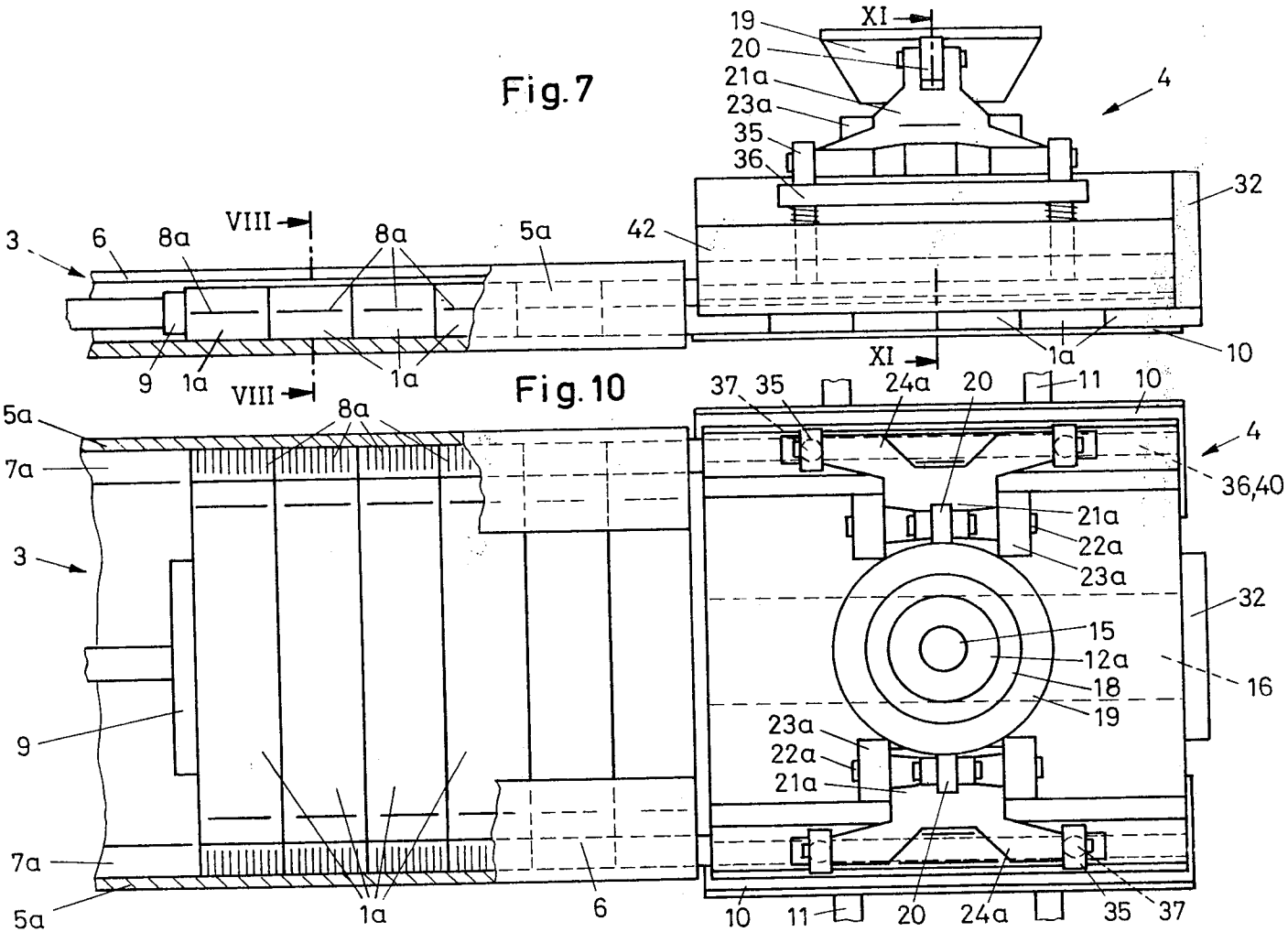
FIG. 7 is a front elevational view of a second embodiment of an insertion apparatus according to the invention.
FIG. 10 is a top plan view of the apparatus of FIG. 7.
Figure 8:
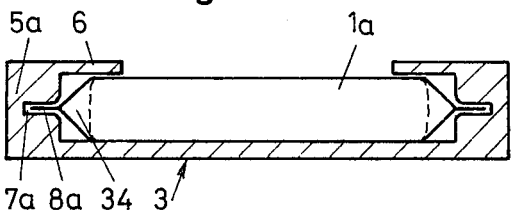
FIG. 8 is a cross-sectional view along the line VIII—VIII of FIG. 7.

Each shaft 22 is provided with two arms 24, each arm being rigidly secured to a respective shaft end and the two arms being connected to each other by means of two adjacent strips 25 and 26 between which are secured five somewhat overlapping leaf springs 27, the arrangement of which is shown in FIG. 6. Each row of leaf springs 27 forms a clamping jaw when the lower ends thereof are disposed opposite a respective one of two counter jaws 28 which protrude laterally from the lower end of element 12.

When the control head 19 is in the downward position shown in FIG. 4, levers 21 are pivoted toward the outside and arms 24 are therefore pivoted downwardly so that the leaf springs 27 press the upwardly folded fins 8 of the packages 1 against the counter jaws 28. Merely for reasons of clarity, FIG. 4 shows small spaces between parts 28, 8 and 27. If head 19 is pulled upwardly, as shown in FIG. 5, the two levers 21 are pivoted inwardly by the tension springs 29 fastened therebetween because head 19 no longer prevents this movement. Consequently, the fins 8 are released by leaf springs 27.

When the pusher 9 advances the five packages ahead of it, the clamping device 4 is of course not in the clamping position of FIG. 4 because otherwise the fins 8 guided in grooves 7 could not get between the leaf springs 27 and the counter jaws 28. On the other hand, the clamping device 4 is not open as wide as shown in FIG. 5 because then the fins 8 released by grooves 7 could flex outwardly past springs 27 and would no longer be gripped properly by the leaf springs 27 during closing. Therefore, when the packages are being advanced into device 4, the leaf springs are disposed at a slight distance from the counter jaw 28, approximately as indicated in FIG. 6, the overlaps between the leaf springs 27 being provided in such a way that the fins 8 advancing in the direction of arrow 31 cannot be impeded by the leaf springs 27. It would of course also be possible to provide a single leaf spring which would extend alongside all five packages. However, five leaf springs 27, each associated with a respective package, assure better operational dependability.

An abutment plate 32 is provided at the downstream end of element 12 facing away from channel 3 to assure that the foremost package 1 will not move too far forward due to its own inertia at the end of the advancing stroke of pusher 9. Thus each one of the five packages 1 stops exactly opposite the respective leaf springs 27 intended for its two fins 8. When the clamping device 4 is closed, as shown in FIG. 4, the entire group of five packages 1 is held together at all package fins 8.

Then the two supports 10 are drawn apart to the passage positions 10' shown in dot-dash lines, and the clamping device 4 is inserted into a container 2. This may be effected by lowering device 4 or by raising the empty container 2 which is placed below apparatus 4, preferably automatically. When the bottom 33 of container 2 is only a short distance away from packages 1, the control head 19 is raised so that the fins 8 are released. Moreover, plunger 15 is moved downwardly so that the packages 1 are definitely released from element 12 and come to rest on the bottom 33 of the container 2.

The clamping device 4 is then filled with a new group of five packages, if necessary after raising it again to the level of channel 3, and the procedure is repeated with the difference that the clamping device 4, before opening, is advanced into the container by an amount less than the height of the layer of packages already in the container 2. In this way, one group is placed onto the other in order to fill the container 2.

With the apparatus of the above-described type, it is possible, for example, to fill a container at a rate of more than 200 packages per minute without malfunctions. The procedure of clamping the fins of a group of juxtaposed finned packages in a common clamping device and inserting them into a container may also be advantageous if certain operations, e.g. the conveyance and raising of the containers and the control of the clamping device, are performed manually. In this case, of course, the desire is not for high output but only for simple and economical operation in the production series involved.

The embodiment shown in FIGS. 7–12 is similar in many respects to the embodiment of FIGS. 1–6 so that a description of the identical parts, which bear the same reference numerals, will not be undertaken. In the embodiment shown in FIGS. 7–12, finned packages **1*a* to be placed into a container 2 differ from packages 1 in that the fins 8*a* are coextensive only with the width of the packages 1*a*, and do not extend further therebeyond. The reason for this is that before the packages were sealed or welded, the end portions of the side walls of the package were folded inwardly in a known manner so that inwardly oriented gussets 34 (FIG. 11) were produced. This has the advantage that the packages 1*a* contact one another regularly everywhere, which is not the case for packages 1. The fins 8*a* are not folded upwardly but lie extended in the major center plane of package 1*a* and protrude into grooves 7*a* in the side walls 5*a* of channel 3**.

The element **12*a* of the clamping device 4 is provided with bearings 23*a* in which a shaft 22*a* is mounted. An angular lever 21*a*, 24*a* is pivotally mounted on shaft 22*a* and is provided at its upper arm 21*a* with the control roller 20 and is provided at two lower arms 24*a*, which are coplanar, with two pressure rollers 35. The pressure rollers 35 press onto an upper strip 36 which is fastened to two guide bolts 37. The bolts 37 are vertically guided in bores 38 of a protruding edge portion 39 of element 12*a* and their lower ends are connected together by means of a lower strip 40. Pressure springs 41 supported at the edge portions 39 are provided on bolts 37 and press the frame-like structure 36, 37, 40 upwardly against rollers 35, and in turn urge levers 24 in a direction to press rollers 12 against head 19**.

Figure 9:
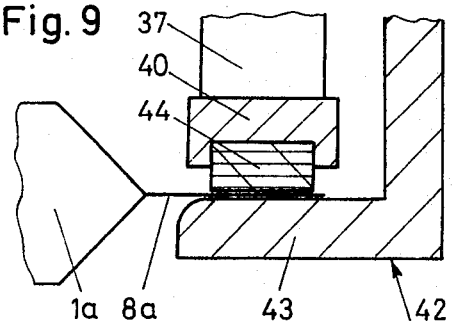
FIG. 9 is a detail view to an enlarged scale, of a portion of the structure shown in FIG. 11.
Figure 11:
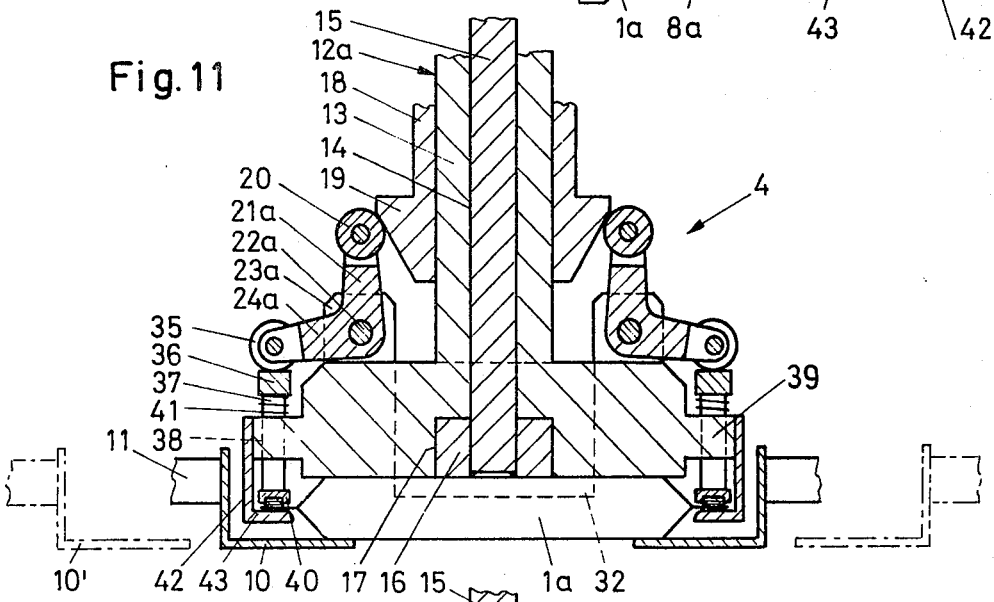
FIG. 11 is a cross-sectional view along the line XI—XI of FIG. 7.
Figure 12:
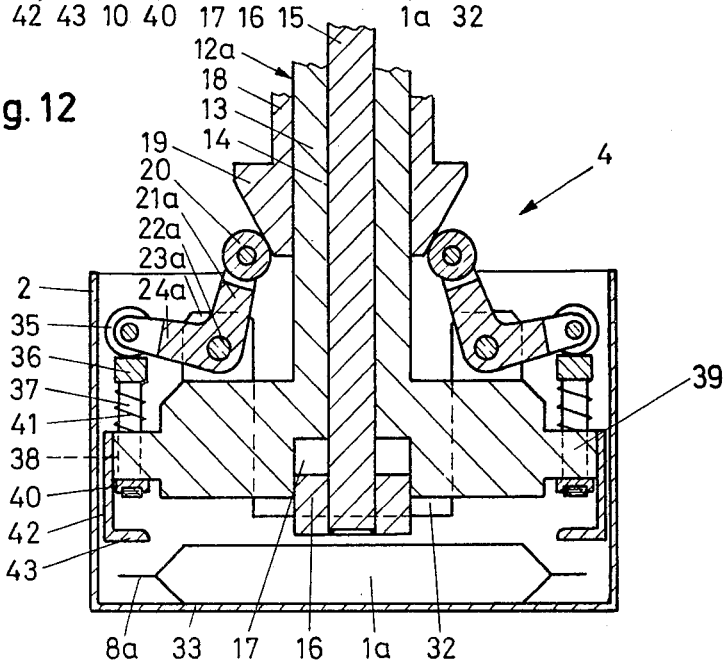
FIG. 12 is a cross-sectional view like that of FIG. 11 but with the parts in a different position.

Angular pieces 42 are fastened to the edge portions 39. Each piece 42 has a horizontal arm 43 which serves as the counter jaw for the lower strip 40 which constitutes the clamping jaw. FIG. 9 shows to a larger scale that the clamping jaw 40 is provided with an elastic lining 44, e.g. of rubber. It is clear that such an elastic lining could also be provided instead, or additionally at the counter jaw 43.

During advancing movement of pusher 9, the fins **8*a* of packages 1*a* leave the grooves 7*a* and come to rest upon the counter jaws 43 against which they are pressed by clamping jaws 40 and their linings 44 when the control head 19 moves downwardly, because then the pressure force of roller 35 or of angular lever 21*a*, 24*a*, respectively, overcomes the force of springs 41. Once the clamped-in packages 1*a* have been introduced into container 2 and have been released by moving the supports 10 apart and raising head 19, they are pushed away again from element 12 by the plunger 15 or its strip-shaped head 16, during which time the fins 8***a* flex and come free from the counter jaws 43 to return to their stretched position.

It is not absolutely necessary for every package 1 or 1*a* to be clamped in at both fins 8 or 8*a;* it may sometimes be sufficient to provide only one clamping jaw with an associated counter jaw. This depends mainly on the material of the package covers since that determines the stiffness of the fins. Generally it is advisable, however, to provide for clamping in of both fins of each package in order to be independent of the cover material.

One embodiment of a conveyor system in which the apparatus according to the invention can be employed, and of components for controlling the operation of this apparatus, is disclosed in my U.S. application Ser. No. 19,604 entitled APPARATUS FOR GROUPING AND INSERTING OBJECTS INTO CONTAINERS, filed on the same date as the present application and claiming priority of Switzerland Application No. 2831/78-2 of Mar. 15th, 1978.

It will be understood that the above description of the present invention is susceptible to various modifications, changes and adaptations, and the same are intended to be comprehended within the meaning and range of equivalents of the appended claims.

What is claimed is:

1. Apparatus for inserting into a container successive groups of finned packages, each finned package having two fins with each fin protruding from a respective one of two opposite ends of the package and each group being composed of a plurality of such packages disposed in abutting relation to one another so that each fin of each package extends along a respective side of the group, said apparatus comprising: a common clamping device for holding one such group of packages at a time and composed of a body defining two counter jaws protruding laterally from its lower end, and means defining two clamping jaws each associated with, and movable relative to, a respective counter jaw, said clamping jaws and counter jaws being positioned relative to one another for permitting the fins along one side of a group to be clamped between one said counter jaw and its associated clamping jaw when the fins at the other side of the group are in a position to be clamped between the other said counter jaw and its associated clamping jaw; and means defining a feed channel upstream of said clamping device for feeding successive groups of finned packages to said clamping device, said feed channel having upwardly extending side walls each presenting a passage for guiding the fins along one side of a group of packages; wherein said feed channel is positioned relative to said clamping device in such a manner that each said passage is aligned with the space formed between a respective counter jaw and its associated clamping jaw, when said jaws are at least partly open.

2. An arrangement as defined in claim 1 wherein each said clamping jaw comprises a plurality of overlapping leaf springs each disposed for clamping a fin of a respective package of a group, and said device further comprises a pivotally movable assembly supporting said springs and provided with a follower, and a displaceable control head against which said follower bears for moving said assembly in response to displacement of said head.

3. An arrangement as defined in claim 1 wherein said clamping jaws are movable in translation and said device further comprises a pivotally movable assembly provided with pressure members and a follower, and a displaceable control head against which said follower bears for moving said assembly in response to displacement of said head.

4. An arrangement as defined in claim 3 further comprising a flexible elastic lining disposed on at least one of said jaws.

5. An arrangement as defined in claim 1 further comprising means for introducing packages in groups into said clamping device ahead of packages located upstream in said channel, and said device comprises two oppositely movable supporting members onto which each group of packages comes to rest when introduced into said clamping device.

6. An arrangement as defined in claim 5 wherein said clamping device is provided with an abutment which limits the forward movement of each group of packages introduced into said clamping device.

7. An arrangement as defined in claim 1 wherein said body of said clamping device includes a guide, and said clamping device further comprises a plunger provided with a head in the form of a strip, said plunger being movable in said guide for pushing each group of packages, via said strip, into such container from said device when said jaws are opened.

* * * * *